United States Patent [19]

Stocker

[11] 4,039,180

[45] Aug. 2, 1977

[54] SHEET FEEDING APPARATUS

[75] Inventor: Lester H. Stocker, Phillipsburg, N.J.

[73] Assignee: Bell & Howell Company, Phillipsburg, N.J.

[21] Appl. No.: 732,255

[22] Filed: Oct. 14, 1976

[51] Int. Cl.[2] ..... B65H 3/06; B65H 7/02

[52] U.S. Cl. ..... 271/10; 271/8 A; 271/110; 271/116; 271/121

[58] Field of Search ..... 271/8 A, 10, 34, 35, 271/110, 111, 114, 116, 121, 124, 126, 149, 150, 258, 265, 268

[56] References Cited

U.S. PATENT DOCUMENTS

| | | | |
|---|---|---|---|
| 1,966,490 | 7/1934 | Ettl | 271/126 |
| 2,762,623 | 9/1956 | Uthenwoldt et al. | 271/116 |
| 2,992,820 | 7/1961 | Tarbuck et al. | 271/110 |
| 3,346,254 | 10/1967 | Beert | 271/10 X |

*Primary Examiner*—Robert W. Saifer

*Attorney, Agent, or Firm*—Griffin, Branigan and Butler

[57] ABSTRACT

Accordion "Z" fold sheets are stacked on end on a tray between a hold-back rod and a follower. A separator assembly is supported from a drive shaft. A first pair of separator rollers are driven by the drive shaft and a second pair of rollers are supported on the separator assembly in tandem with the first pair of rollers. The second pair of rollers rotate simultaneously with and at the same speed as the first pair. A sheet abutting step is positioned below the first pair of rollers and an idler roller is below the second pair. The drive to the separator assembly is controlled by a micro-switch in the feed path below the separator assembly. The tray is provided with adjustable guides and teflon slide pads.

16 Claims, 3 Drawing Figures

SHEET FEEDING APPARATUS

BACKGROUND OF THE INVENTION

This invention relates to a sheet feeding apparatus, particularly one which may be used in conjunction with an inserting device as, for example, the Phillipsburg Expediter inserter models.

In the above-mentioned inserters, gripper arms are provided adjacent separator assemblies to grip single, separated sheets and to deposit those sheets into an insert raceway for subsequent insertion into envelopes or the like. Timing of each gripper arm is controlled by cams in accordance with predetermined, sequential functions. Although standard sheet feeders have been found adequate for positioning single, non-folded sheets into position to be gripped by the gripper arms, where it is intended to feed accordion Z fold inserts problems resulting in jamming of the feeder or improper gripping by the gripper arm have been significant.

It is an object of this invention to provide a sheet feeding device capable of feeding accordion Z fold inserts which may easily be installed in standard inserter machines.

It is well known to use separator rollers adjacent abutment means to separate sheets stacked on end in a tray. One example of such a device is found in U.S. Pat. No. 2,762,623 to Uthenwoldt, et al. issued Sept. 11, 1956. In this patent, partially separated sheets are gripped between an idler roller and a feed roller driven separately from the separating roller. The separating roller is provided with an overrunning clutch so that a sheet may be drawn freely from the separator roller by the feed roller, which moves at a higher speed than the separator. The patented device also includes a booster roller which contacts the top sheet in the stack to urge a sheet into a ready position at the separator roller. If the feeding device of Uthenwoldt et al. were to be used with accordion Z fold inserts, the top sheet portion of the insert would tend to move ahead of the lower sheet portion which is held back by the abutment means, tending to warp the insert to some extent. When the thusly warped insert is then gripped by the higher speed feed roller, jamming is likely to result as the upper sheet portion, now somewhat ahead of the lower sheet portion, is gripped and pulled even further ahead of the lower sheet portion.

It is therefore an object of this invention to provide a sheet feeding device able to feed accordion fold inserts without jamming.

Because the sheet feeder of the present invention is to be used with a standard inserting machine, it is a further object of this invention to provide a completely self controlled unit which will respond to removal of a sheet by a gripper arm.

SUMMARY OF THE INVENTION

Sheets stacked on end in a tray are sequentially separated from the stack by a separating assembly supported from a drive shaft. First and second pairs of tandem rollers are simultaneously driven by the drive shaft and an abutment means is provided below the first pair of rollers.

BRIEF DESCRIPTION OF THE DRAWINGS

The foregoing and other objects, features and advantages of the invention will be apparent from the following more particular description of a preferred embodiment of the invention, as illustrated in the accompanying drawings, in which like reference characters refer to the same parts throughout the different views. The drawings are nor necessarily to scale, emphasis instead being placed upon illustrating the principles of the invention.

DESCRIPTION OF A PREFERRED EMBODIMENT

Figure 1:
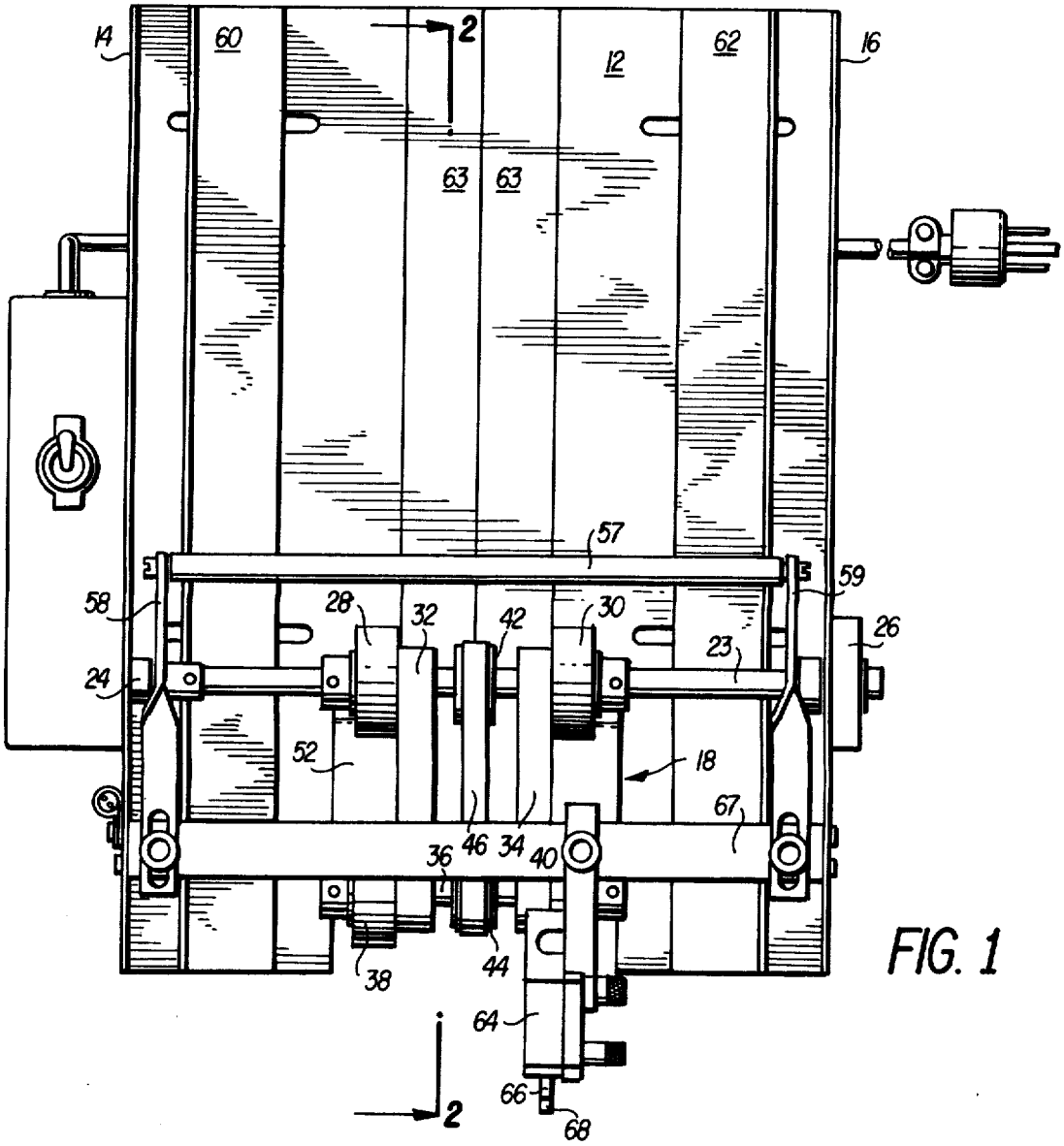
FIG. 1 is a top view of a sheet feeder made in accordance with the present invention.
Figure 3:
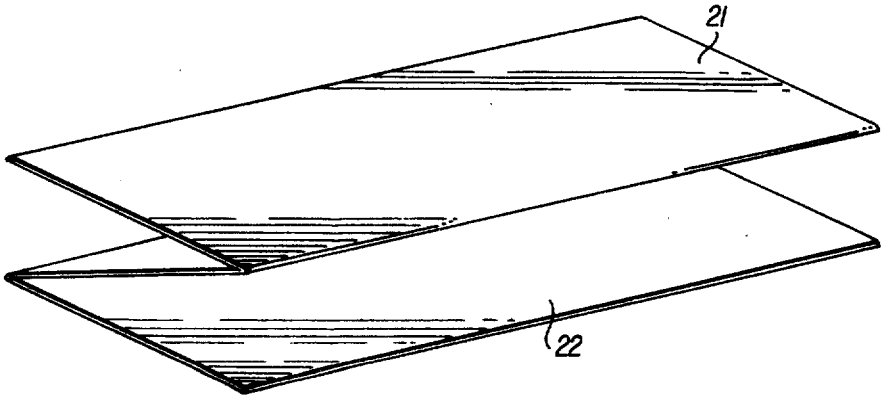
FIG. 3 is an isometric view of an accordion Z fold.
Figure 2:
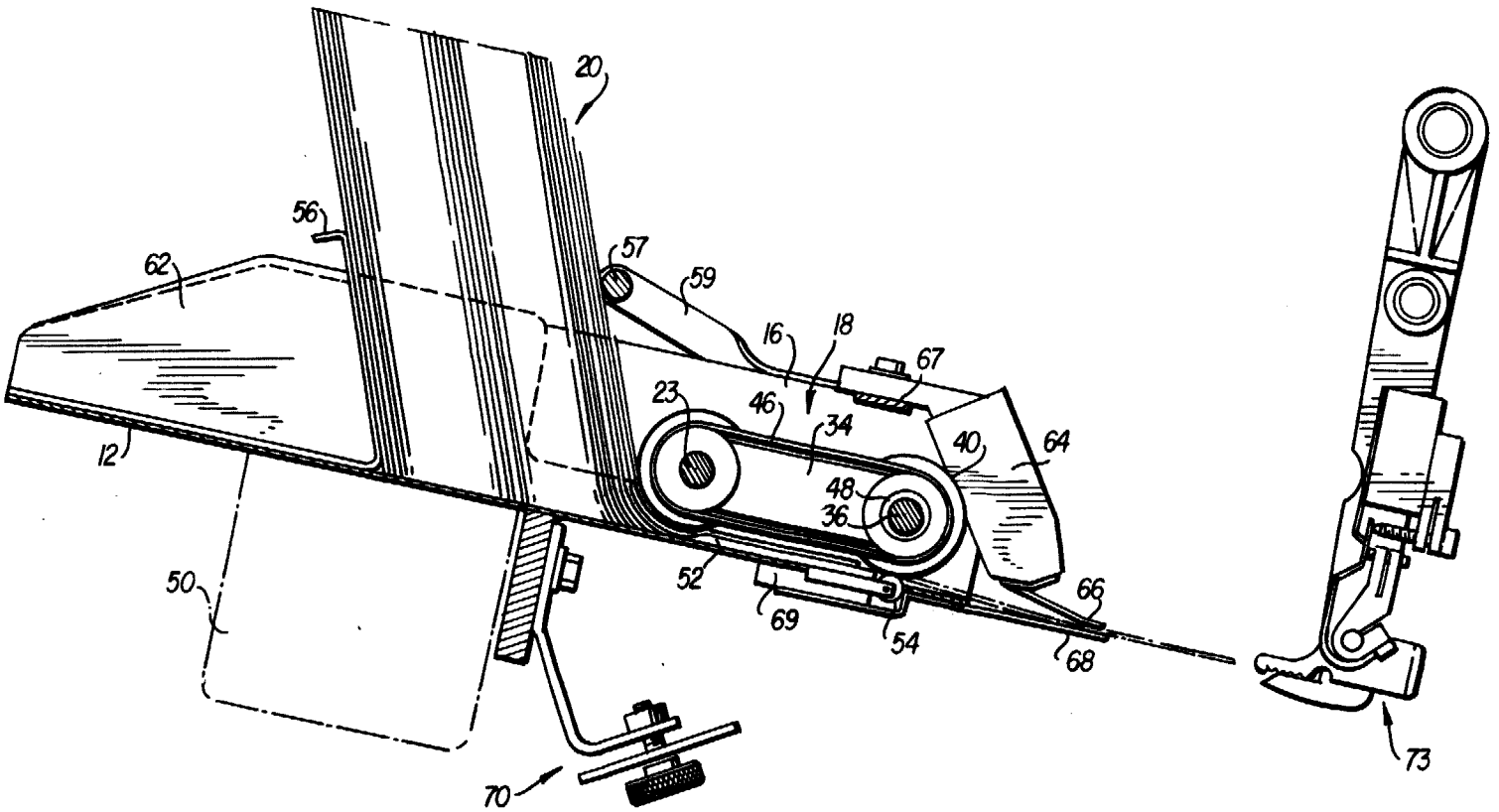
FIG. 2 is a sectional view of the sheet feeder of FIG. 1 taken along line 2—2, further showing a gripper arm and sheet stack.

As shown in FIGS. 1 and 2, a feed tray having base plate 12 and sides 14 and 16 is provided with a sheet separating assembly 18 for sequentially separating individual sheets from a stack 20 of sheets on end. Although shown as single flat sheets, the present separator is particularly designed for feeding accordion Z fold sheets as shown in FIG. 3. Such sheets have an upper folded portion 21 and a lower folded portion 22.

The sheet separator means 18 is supported by a drive shaft 23, which extends across the feed tray base plate 12. The drive shaft 23 rides in left and right bearing assemblies 24 and 26, mounted on the feed tray sides 14 and 16. Separator rollers 28 and 30 are mounted to drive shaft 23 to be driven thereby. These rollers are preferably of rubber having circumferential serrations.

Also supported by drive shaft 23 are frame members 32 and 34. Bearing assemblies, not shown, are provided in frame members 32 and 34 so that drive shaft 23 is free to rotate therein. A second drive shaft 36, also passes through frame members 32 and 34 and is free to rotate therein. Rollers 38 and 40. of the same construction and diameter as rollers 28 and 30, are fixed to second drive shaft 36 to be driven thereby. Drive to drive shaft 36 is provided from drive shaft 23 through timing wheels 42 and 44, and a timing belt 46. For reasons set forth below, timing wheel 44 is provided with an overrunning clutch 48.

Drive to the drive shaft 23 is by means of a motor 50 mounted below the feed tray. The drive connection is by means of pulleys and a timing belt not shown.

Mounted to the feed tray base 12 below rollers 28 and 30 is an abutment step 52 of high friction material. An idler roller 54 is positioned below rollers 38 and 40.

In order that the clearance between the separator rollers 28 and 30 and the feed tray base plate 12 may be adjusted, the mounting holes to the bearing assemblies 24 and 26 are eccentrically located with respect to the center line of the bearings and drive shaft 23. If the assemblies are rotated 180° prior to mounting, the clearance will thus be changed.

Because the separator frame members are free to pivot about drive shaft 23, the rollers 38 and 40 will automatically lift as a sheet passes thereunder and will provide the proper clearance.

The stack of sheets is maintained in an upright position by a follower 56 and a hold-back rod 57. The hold-back rod extends across the feed tray base 12 between brackets 58 and 59. The positions of these brackets are adjustable in order to vary the angle of entry of the sheets into separator 18.

To properly center the stack of sheets in line with the separator assembly, left and right adjustable guide walls 60 and 62 are provided. Because the stack of sheets is held against the separator assembly by gravity alone, the feed tray base 12 is provided with two anti-friction slide pads 63 preferably of polytetrafluoroethylene (sold under the trademark Teflon). The Teflon reduces friction which would otherwise hold back weighted follower 56.

Because the present feeder is to be controlled independently of the electronic controls of the inserter machine, a micro-switch 64 having switch arm 66 is provided in the sheet feed path, supported by brace 67. A switch guide 68 mounted to a spacer 69 maintains a proper spacing for detection of sheets.

A mounting clamp 70 is provided for mounting the sheet feeder to an insert machine or the like.

As best shown in FIG. 2, when drive shaft 23 is rotated, the first sheet in stack 20 is drawn under separator rollers 28 and 30. This sheet is lifted into the feed wheels by an abutment step 52 which also acts as a drag to hold back subsequent sheets and thus eliminate double feeding. The partially separated sheet is then passed between rollers 38 and 40 and the idler roller 54. Rollers 38 and 40 are driven at substantially the same speed as rollers 28 and 30.

As noted above, when a Z fold insert is passed between rollers 28 and 30 and the abutment step 52, the upper folded portion 21 will tend to move ahead of the lower folded portion 22 which is held back to some degree by abutment step 52. Prior sheet feeders failed to correct this warping of the insert and sheet jamming was the likely result. In the present device, however, a second pair of feed rollers is provided in tandem with the first separating rollers and is driven at substantially the same speed as the first rollers. Because the two pairs of rollers are driven at substantially the same speed, the upper fold will not be accelerated further ahead of the lower fold by rollers 38 and 40. Once the trailing edge of the insert has passed between rollers 28 and 30 and the abutment step 52 it is able to resume its original flat shape because idler roller 54 permits the lower fold to make up for any drag caused by the abutment step 52.

Once the single sheet passes between micro-switch arm 66 and switch guide 68 the drive to shaft 23 will be discontinued and the insert will stop while still positioned as indicated by the phantom outline in FIG. 2 between rollers 38 and 40 and idler roller 54. According to the timing sequence of the inserter machine a gripper arm 73 will grip the insert which is now extending beyond the base plate 12 of the feed tray. The gripper arm 73 will then pull the insert away from rollers 38 and 40 which are now free to rotate due to overrunning clutch 48.

With the insert removed, switch arm 66 again falls and the drive to shaft 23 is again activated. Another sheet will now be fed by separator means 18 to switch arm 66 to again deactivate the drive.

While the invention has been particularly shown and described with reference to a preferred embodiment thereof, it will be understood by those skilled in the art that various changes in form and detail may be made therein without departing from the spirit and scope of the invention as defined by the appended claims.

I claim:

1. An apparatus for sequentially feeding sheets, such as paper sheets from a stack, said apparatus comprising:

a feed tray, said feed tray positioned at an angle above the horizontal;

means for holding a stack of sheets on said feed tray, each sheet of said stack being held on end; and separator means over the lower end of said tray, said separator means comprising, a first drive shaft, said first drive shaft extending over and across said feed tray, a first pair of separator rollers mounted on said firsrt drive shaft to be driven by said first drive shaft, a support frame, extending from said first drive shaft toward the lower end of said feed tray, said support frame being supported for free rotation on said first drive shaft, a second drive shaft, supported by said support frame, a second pair of separator rollers mounted on said second drive shaft to be driven in a forward direction, means for driving said second drive shaft and said second pair of separator rollers from said first drive shaft, such that said second pair of separator rollers will rotate simultaneously with and at substantially the same speed as, said first pair of separator rollers, drive means for driving said first drive shaft, and sheet abutment means between said first pair of separator rollers and said feed tray, said sheet abutment means acting to prevent double feeding of sheets passing between said abutment means and said first pair of separator rollers.

2. The apparatus of claim 1 further comprising hold-back means over said tray for holding back the top of said stack to maintain a constant angle of entry of said sheets into a path under said sheet separating means.

3. The apparatus of claim 2 wherein said hold-back means comprises a rod extending over and across said feed tray.

4. The apparatus of claim 2 further comprising follower meams positioned behind said stack toward the upper end of said tray to hold said sheets in said stack on end.

5. The apparatus of claim 1 wherein said feed tray is at least partially covered with polytetrofluoroethylene.

6. The apparatus of claim 1 further comprising first and second adjustable guide assemblies mounted to said feed tray for aligning said stack in a sheet feeding position centered behind said separator means.

7. The apparatus of claim 1 wherein said means for driving said second drive shaft comprises a timing belt around said first and second drive shafts.

8. The apparatus of claim 1 including an overriding clutch means associated with said second drive shaft whereby said second pair of separator rollers will be driven by said first and second drive shafts, but said second pair of separator rollers are free to rotate independently on said first pair of separator rollers when said first drive shaft is not being driven by said drive means.

9. The apparatus of claim 1 further comprising at least one idler roller below said second pair of separator rollers.

10. The apparatus of claim 1 further comprising detector means for detecting the presence of a sheet in a position between said second pair of separator rollers and said feed tray;

means for stopping said drive means responsive to a sheet being detected at said position;

means other than said separator means for removing said sheet from said position; and means for starting said drive means responsive to no sheet being detected at said position.

11. The apparatus of claim 10, wherein said detector means comprises a micro-switch.

12. An apparatus for sequentially feeding sheets such as paper sheets from a stack, said apparatus comprising:

a feed tray, said feed tray positioned at an angle above the horizontal;

follower means positioned behind said stack toward the upper end of said tray to hold said sheets in said stack on end;

separator means over the lower end of said tray, said separator means comprising a first drive shaft, said first drive shaft extending over and across said feed tray, a first pair of separator rollers mounted on said first drive shaft to be driven by said first drive shaft, a support frame extending from said first drive shaft toward the lower end of said feed tray, said support frame being supported but not driven by said first drive shaft, a second drive shaft supported by said support frame, a second pair of separator rollers mounted on said second drive shaft to be driven in a forward direction, a timing belt for driving said second drive shaft and said second pair of separator rollers from said first drive shaft, such that said second pair of separator rollers will rotate simultaneously with and at substantially the same speed as said first pair of separator rollers, overrunning clutch means whereby said second pair of separator rollers will be driven by said first and second drive shafts, but said second pair of separator rollers are free to rotate independently of said first pair of separator rollers when said first drive shaft is not being driven by said drive means, at least one idler roller adjacent said second pair of separator rollers, and sheet abutment means between said first pair of separator rollers and said feed tray, said sheet abutment means acting to prevent double feeding of sheets passing between said abutment means and said pair of separator rollers;

hold-back means over said tray for holding back the top of said stack to maintain a constant angle of entry of said sheets into a path under said sheet separating means;

detector means for detecting the presence of a sheet in a position between said second pair of separator rollers and said idler rollers;

drive means for driving said first drive shaft;

means for stopping said drive means responsive to sheet being detected at said position;

means other than said separator means for removing said sheet from said position; and means for starting said drive means responsive to a failure to detect a sheet at said position.

13. The apparatus of claim 12 wherein said feed tray is at least partially covered with polytetrafluoroethylene.

14. The apparatus of claim 12 further comprising first and second adjustable guide assemblies mounted to said feed tray for aligning said stack in a sheet feeding position.

15. The apparatus of claim 12 wherein said hold-back means comprises a rod extending over and across said feed tray.

16. The apparatus of claim 12 wherein said detector means is a micro-switch.

* * * * *